US006877251B2

(12) United States Patent
Ihme

(10) Patent No.: US 6,877,251 B2
(45) Date of Patent: Apr. 12, 2005

(54) DRYING INSTALLATION WITHIN A SHEET-FED PRINTING PRESS

(75) Inventor: Andreas Ihme, Goldbach (DE)

(73) Assignee: MAN Roland Druckmaschinen AG, Offenbach (DE)

( * ) Notice: Subject to any disclaimer, the term of this patent is extended or adjusted under 35 U.S.C. 154(b) by 206 days.

(21) Appl. No.: 10/332,514

(22) PCT Filed: Jun. 12, 2001

(86) PCT No.: PCT/EP01/06612

§ 371 (c)(1),
(2), (4) Date: May 5, 2003

(87) PCT Pub. No.: WO02/04212

PCT Pub. Date: Jan. 17, 2002

(65) Prior Publication Data

US 2003/0206225 A1 Nov. 6, 2003

(30) Foreign Application Priority Data

Jul. 12, 2000 (DE) ..... 100 33 839

(51) Int. Cl.[7] ..... F26B 13/00

(52) U.S. Cl. ..... 34/618; 34/620; 34/623; 34/635; 34/254; 34/251; 34/253; 34/273

(58) Field of Search ..... 34/245, 246, 250, 34/251, 253, 254, 273, 611, 618, 620, 623, 635; 219/770, 773, 775, 779, 388; 392/417; 100/301

(56) References Cited

U.S. PATENT DOCUMENTS

| | | | | | |
|---|---|---|---|---|---|
| 4,434,353 | A | * | 2/1984 | Marsh et al. | 219/216 |
| 4,456,370 | A | * | 6/1984 | Hayes, Jr. | 399/50 |
| 5,152,838 | A | | 10/1992 | Kisler | |
| 5,410,388 | A | * | 4/1995 | Pacer et al. | 399/49 |
| 6,285,032 | B1 | | 9/2001 | Hahne et al. | |

FOREIGN PATENT DOCUMENTS

| | | | |
|---|---|---|---|
| DE | 37 08 925 | A1 | 11/1987 |
| DE | 195 25 453 | A1 | 1/1997 |
| WO | WO 91/12095 | A | 8/1991 |

* cited by examiner

*Primary Examiner*—Jiping Lu
(74) *Attorney, Agent, or Firm*—Leydig, Voit & Mayer

(57) ABSTRACT

A drying apparatus for a sheet-fed offset printing machine which dries sheets as they pass along a sheet path with forcefully directed air and/or heat. The drying apparatus of the present invention is adapted for more effective sheet drying by means of an electrode and a corresponding counter electrode, wherein the electrode is connected to a high-voltage source and a high voltage is applied to the electrode by the high-voltage source in dependence on the operation of the sheet-fed printing machine and/or the length of the sheets.

16 Claims, 3 Drawing Sheets

DRYING INSTALLATION WITHIN A SHEET-FED PRINTING PRESS

FIELD OF THE INVENTION

The present invention relates generally to printing machines, and more particularly to a drying apparatus for sheet-fed printing machines.

BACKGROUND OF THE INVENTION

In sheet-fed offset printing machines, the sheets to be printed are transported through individual printing stations and, after the last printing station, through one or more varnishing or other converting devices by means of cylinders and drums. The transport of the sheets from the last drum to the delivery stack commonly is effected by a chain-type sheet transfer system.

Drying apparatuses are provided at various locations within the printing machine in order to prevent the freshly printed sheets from becoming smeared during their transport between the individual printing stations and between the last printing station and the delivery station or the varnishing unit. The drying apparatuses are provided for drying/absorbing the ink/varnish as rapidly as possible such that any contact between the printed side of the sheet and sheet guiding plates or other stationary parts of the printing machine does not damage the printed side of the sheets and consequently, waste sheets.

Printing inks or varnishes that are based on solvents release solvent vapors during the drying process. The drying process can be accelerated with the aid of IR radiators because the evaporation of the solvent is expedited by applied heat. The drying process additionally can be accelerated if the printed sheet is subsequently impacted with warm air because the solvent vapors released by the printed sheet due to the applied heat can be transported away in this fashion. In drying processes of this type, the air that is saturated with solvent and water vapor also can be removed by suction. However, this requires a special suction apparatus.

DE 195 25 453 A1 discloses a drying method for rapidly moving webs to be printed, wherein an electrode connected to a high-voltage source is disposed adjacent the drying apparatuses. The electric charge from the electrode in the direction of the material to be printed (i.e. rapidly moving web) causes a destruction of a laminar boundary layer entrained by the moving web. This laminar boundary layer that is entrained by the web material to be printed inhibits the mass transfer of solvent and water vapor from the material being printed, i.e., the mass transfer coefficient is lowered. However, this drying principle which utilizes a high-voltage electrode can only be used on rapidly moving webs and is not suitable for sheet-fed printing machines in the form disclosed herein.

OBJECTS AND SUMMARY OF THE INVENTION

It is an object of the present invention to provide an improved drying and heating apparatus particularly adapted for drying printed material in sheet-fed printing machines.

In carrying out the invention, the drying apparatus contains an electrode (E) and a corresponding counter-electrode, wherein the electrode is connected to a high-voltage source (HV) and a high voltage is applied to the electrode by the high-voltage source in dependence on the operation of the sheet-fed printing machine and/or the length of the sheets (B). The drying apparatus preferably also contains a suction device that makes it possible to remove by suction the vapors released from the material being printed and the printing ink due to applied heat and air.

According to one embodiment of the invention, the drying apparatus preferably contains an IR radiator such that the material being printed and the ink and/or varnish layer can be subjected to the precise wavelength that stimulates the solvent. According to this embodiment of the invention, IR radiators subject the moving sheets to radiation with a wavelength with which only the solvent is heated. Due to the electrode being positioned a short distance from the sheet surface and arranged downstream of the IR radiatoras viewed in the transport direction of the sheets, the mass transfer coefficient is increased by destroying laminar air layers above the sheet surface. This leads to an improvement in the mass conveyance and of solvents. A pre-heated air current that simultaneously acts upon the sheets additionally enhances the evaporation of solvents from the material being printed, and the air that is enriched with the solvent/water is simultaneously transported away. A corresponding device makes it possible to remove by suction the air that is enriched with solvent/water from the region of the drying apparatus and ultimately the printing machine.

The drying apparatus according to the inventions which is also provided with an electrode and a corresponding counter-electrode, can be used at various locations within the sheet-fed offset printing machine. In further carrying out the inventions a high voltage can be applied to the electrode in dependence on the printing speed and/or the length of the sheets being printed. It will be understood that the electrodes must be maintained a proper predetermined distance from the traveling sheets. In this context, it must be ensured that sheet holding devices, e.g., the gripping fingers of the cylinders that guide the sheets or the gripper systems of the delivery station, do not collide with the electrode or the counter-electrode. This problem can be solved by movably suspending the electrode or the carrier of the electrode and/or the counter-electrode assigned to the electrode such that they yield when the grippers or the sheet holding devices pass. Such a movable suspension of the electrode or the entire drying apparatus which is controlled in dependence on the sheet movements is particularly advantageous if the drying apparatus according to the invention should be assigned to the obverse or printed side of the sheet in the delivery station of the printing machine. The gripper systems that hold the sheets may control the required yielding movements of the electrode by means of sensors arranged at the intended locations. Hence the yielding movement of the electrode and/or the counter-electrode relative to the gripper systems will prevent the electrodes from impeding travel of the gripper systems.

Due to the movable suspension of the dryer and the electrode or the assigned counter-electrode relative to the sheet arrival in the delivery station, one or more drying apparatuses according to the invention can be provided in the entrance of the delivery station. This intensifies the drying effect in the region of the delivery station such that extensions within the delivery station, which can be costly to construct are unnecessary.

The electrode according to the invention for promoting the drying effect is provided with at least one air-directing device that preferably subjects the sheets to warm air. The air current produced by this device preferably is generated in such a way that the sheet and, in particular, the sheet end cannot contact the electrode and parts associated with the electrode.

The electrode according to the invention or the drying apparatus, respectively, may be arranged at various locations within a sheet-fed offset printing machine. For example, it is possible to arrange the electrode and the drying apparatus in the sheet guide upstream of the first offset printing station. This type of installation is particularly preferred in instances in which a flexographic printing station is arranged upstream of the printing stations.

The drying apparatus according to the invention also can be arranged within the sheet guide between the printing stations and assigned to the printed side of the sheet. In this case, the drying apparatus is directly installed into the sheet guiding plates opposite the counter-pressure cylinder. The electrodes can be installed by interrupting the plate-type sheet guide and installing a non-conductive material, for example, a plastic or ceramic material, into which the electrode is embedded. In this case, the counter-pressure cylinder serves as the counter-electrode and needs to be electrically grounded accordingly.

The drying apparatus according to the invention also may be arranged in the sheet guide between the printing stations and assigned to the reverse side of the sheet. In the turning and reverse printing mode, two channels can be arranged in the counter-pressure cylinder such that they are offset relative to one another by 180°, wherein the electrode that is surrounded by a non-conductive material is embedded into the channels. In this case, the counter-electrode is embedded in a non-conductive material and installed in the sheet guide. The distance between the electrode and the sheet can be precisely adjusted depending on the respective requirements.

The drying apparatus also can be installed in the sheet guide between varnishing stations and assigned to the obverse. In this case, the installation is carried out analogous to the installation between the printing stations.

It also is possible to arrange the drying apparatus according to the invention in a delivery drum or a sheet-guiding drum in the form of a stationary apparatus. The sheet being transported by the delivery or sheet guiding drum is subjected to the ionic radiation of the stationary electrode past which the sheet is transported.

As in the case of an installation between the printing stations in which the sheets are dried on the reverse side, the drying apparatus according to the invention also may be arranged between two or more varnishing stations.

The drying apparatus also may be installed between the last printing station and the delivery station or within the delivery station at a location upstream of the delivery stack. The sheets can be dried on the printed and on the reverse sides by correspondingly suspending the drying apparatus according to the invention statically or such that it can be moved in accordance with the sheet transport.

One or more drying apparatuses in accordance with the invention can be assigned to the printed side of the sheet in an extension module in which the sheets are transported by a cylinder provided with grippers. These drying apparatuses preferably are adjustable relative to the material being printed. One or more drying apparatuses in accordance with the invention also may be arranged in the take-off drum or the ensuing transport path of the chain system. As mentioned above, a drying apparatus and/or that acts upon the printed side of the sheet needs to be suspended such that it can be moved in a controlled fashion in accordance with the sheet transport to prevent the risk of collisions with the gripper systems.

The counter-electrode assigned to the electrode may consist of the printing cylinder or the counter-pressure cylinder (i.e. their metallic surfaces), a sheet guiding plate or a metallic surface arranged on a sheet-guiding cylinder. It also is possible to provide the drying apparatus on a turning drum. In this case, the counter-electrode assigned to the stationary electrode is preferably formed by the surface of the drum.

Other objects and advantages of the invention will become apparent upon reading the following detailed description and upon reference to the drawings, in which:

BRIEF DESCRIPTIONS OF THE DRAWINGS

Figure 1:
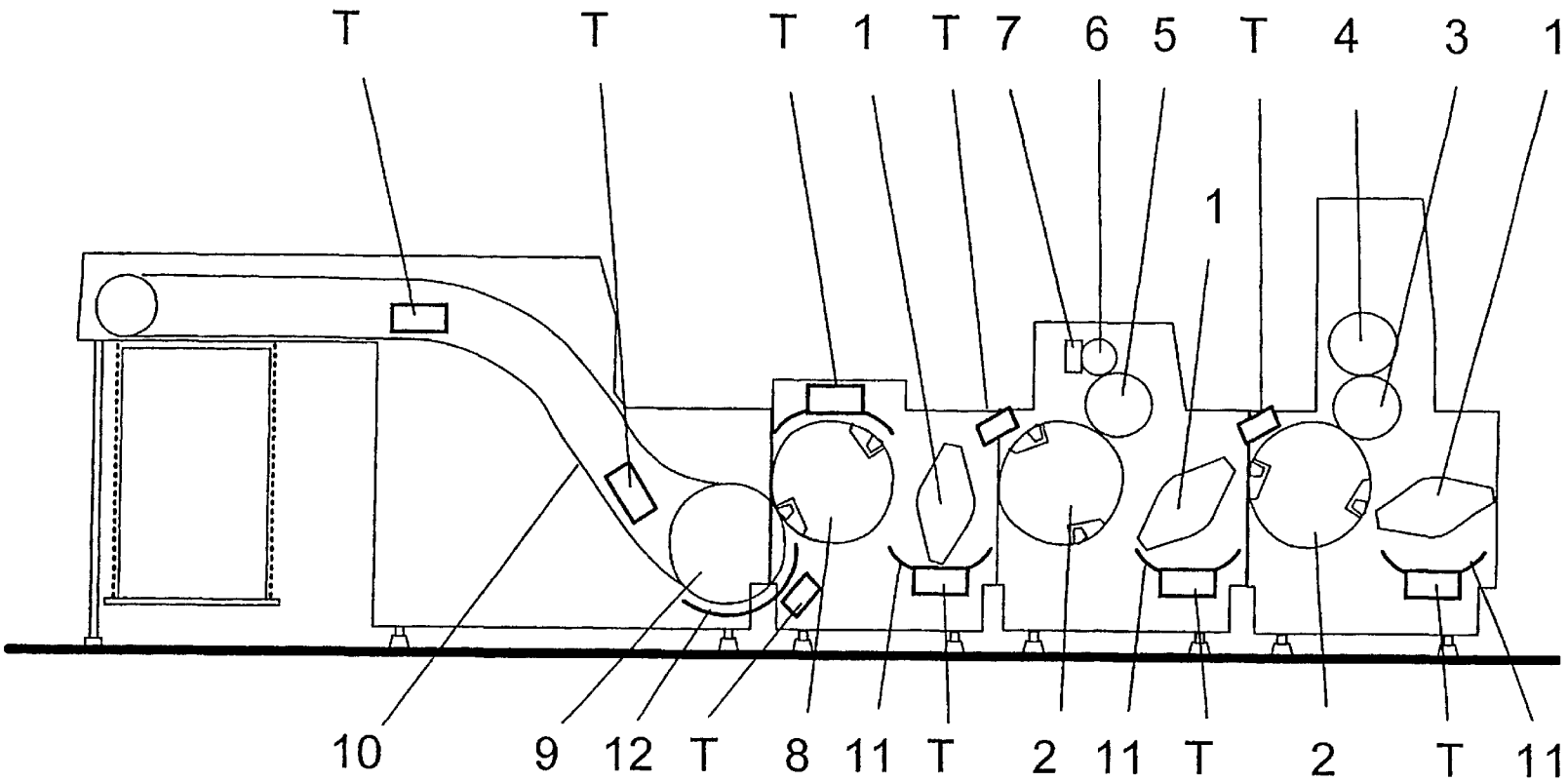
FIG. 1 is a diagrammatic depiction of a sheet-fed printing machine having drying apparatuses in accordance with the invention, in this case showing a last printing station, an extension module, a varnishing station, and a delivery station.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENT

Referring now more particularly to FIG. 1 of the drawings, there is shown an illustrative sheet-fed printing press having drying apparatuses in accordance with the present invention. The illustrated printing machine includes one or more printing stations, the last printing station of which is depicted in the drawing. The illustrated printing station includes a counter-pressure cylinder 2, a rubber blanket cylinder 3 and a plate cylinder 4. A transfer drum 1 for transporting the sheets from the preceding printing station is arranged upstream of the counter-pressure cylinder 2. The sheets transported by the transfer drum 1 are supported on the reverse side (i.e. opposite the printed side) by a sheet guide 11.

A varnishing station in this case is provided immediately downstream of the counter-pressure cylinder 2 of the last printing stations. The varnishing station in this case includes a counter-pressure cylinder 2, a form cylinder 5, an application roller 6 and a chamber doctor blade 7 that cooperates with the screened application roller 6, arranged downstream of the counter-pressure cylinder 2 of the last printing station. From the counter-pressure cylinder 2 of the last printing station, the sheets are fed to the counter-pressure cylinder of the varnishing station by means of a respective transfer drum 1 having a sheet guide 11. The sheets situated on the counter-pressure cylinder 2 in the varnishing station are fed to the take-off drum 9 of a delivery station by means of an additional transfer drum 1 and a sheet guiding drum 8 of an extension module. The sheets are fed from the take-off drum 9 to the delivery stack by means of gripper systems 10.

Sheet guides 11 that support the sheets on the reverse side are assigned to the transfer drums 1. In addition, a sheet guide 12 is assigned to the take-off drum 9. The sheet guides 11, 12, may consist of sheet guiding plates that can be subjected to suction air and/or blasting air, sheet guiding rods or the like.

In accordance with the invention, dryer apparatuses are provided along the sheet path which are adapted for more effective heating and drying of the passing sheets. Each dryer apparatus T in this case, as depicted in FIG. 2, includes a radiator SL, preferably in the form of an infrared IR radiator, a blasting device TL arranged downstream of the radiator as viewed in the sheet transport direction which acts upon the sheet B with diffuse warm air, an electrode E schematically depicted in FIG. 2, and a suction device S arranged downstream of the aforementioned devices as viewed in the sheet transport direction.

Figure 3:
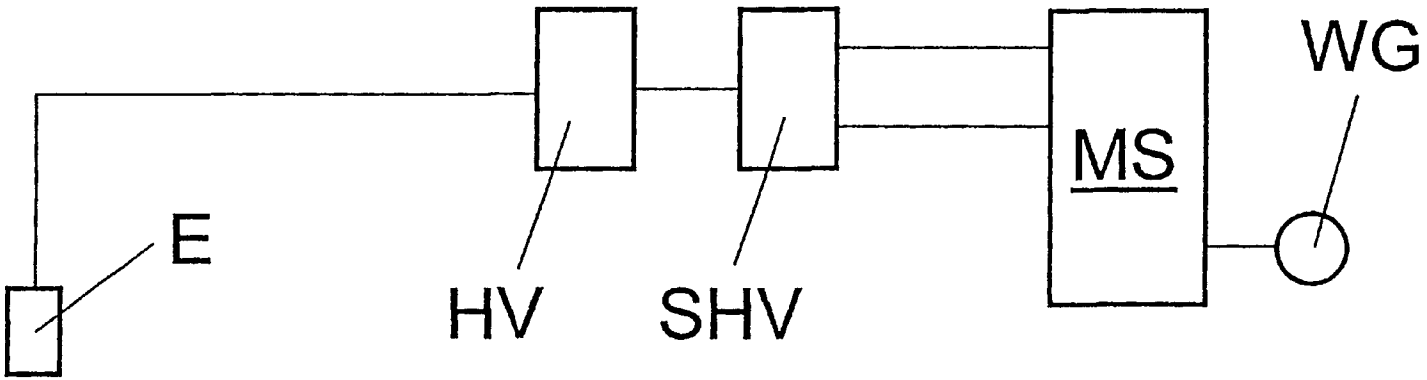
FIG. 3 is a diagrammatic depiction of a control for the illustrated drying apparatus.

In carrying out the invention, a voltage control for the electrode is provided which is effective for controlling high voltage to the electrode in response to predetermined operation of the printing machine. As depicted in FIG. 3, the electrode E in this case is connected to a high voltage source HV. The voltage source HV in turn is connected to an appropriate control SHV such that the times at which the voltage is applied to the electrode E, as well as the intensity of this voltage, can be precisely adjusted by the control SHV. A signal connection that is indicated by lines in this figure is provided between the control SHV for the electrode E and the machine control MS. The machine control MS contains an angle transmitter WG that is mounted, in particular, on a single-speed shaft of a rotary element of the printing machine. The times at which the voltage is applied to the electrode E at a given point can be determined by the machine control SM and the control of the high-voltage source SHV based on the signals from the angle transmitter. The signals of the angle transmitter WG make it possible to determine at which time a gripper system in the transport path 10 of the delivery station passes the electrode E. In addition, the signals of the angle transmitter WG make it possible to control the high-voltage source HV in such a way that the sheet B is subjected to the required ionic current that positively influences the drying properties in dependence on the printing speed and the length of the sheet.

In carrying out a further aspect of the invention, each electrode and/or counter electrode as the case may be is mounted on an appropriate support adjustably movable support SP that is actuatable by appropriate means, such as a screw drive or pneumatic cylinder, for selective movement of the dryer apparatus T relative to the sheet path, and preferably in a direction perpendicular to the sheet path. Hence, the actuatable support SP for the electrode is able to selectively move the electrode out of the sheet path, as may be necessary to prevent interference with gripping devices or the like of the sheet transfer system. The distance between the electrode E and the sheet or the counter-electrode can be adjusted and controlled by the control SHV in accordance with predetermined values.

Figure 2:
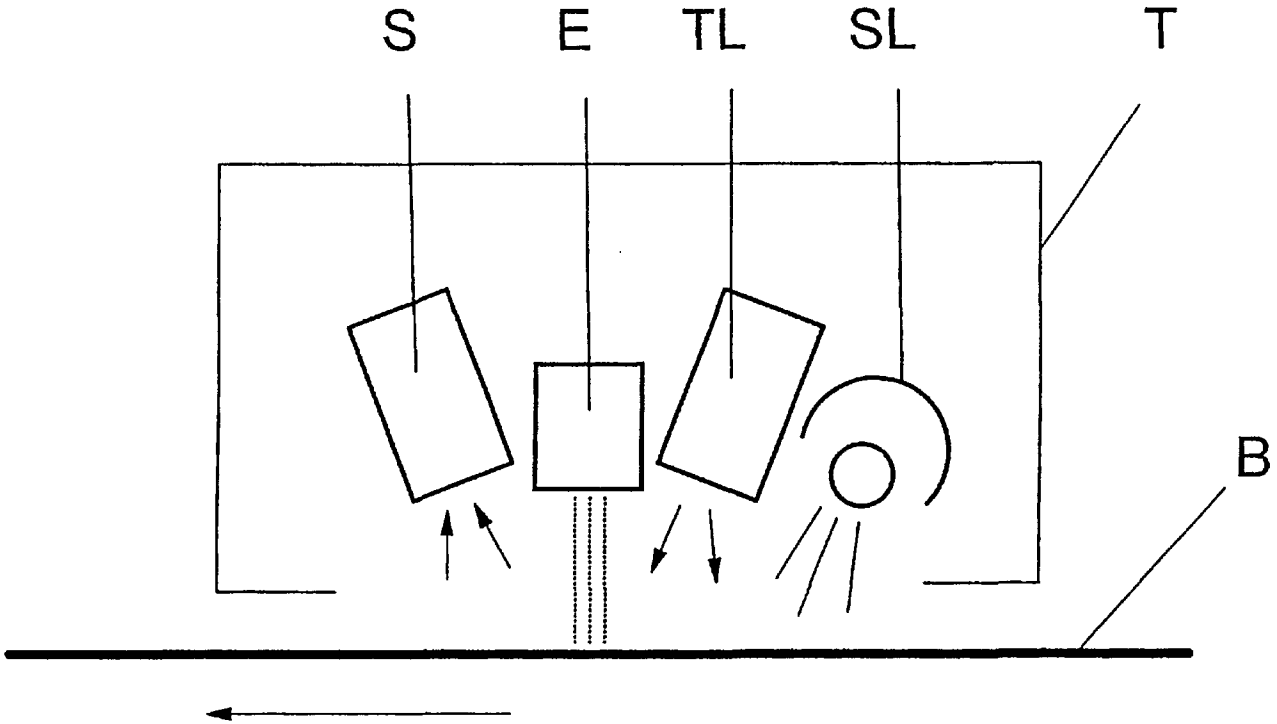
FIG. 2 is a diagrammatic depiction of a drawing of one of the drying apparatuses of the illustrated machine.

FIG. 1 shows preferred locations for the drying apparatus illustrated in FIG. 2. According to FIG. 1, one or more drying apparatuses T may be assigned to the sheet guide 11 of the last printing station, the varnishing station and the extension module. It also is possible to assign a drying apparatus T to the surface of the counter-pressure cylinder 2 of the last printing station downstream of the rubber blanket cylinder 3. One or more drying apparatuses T also may be assigned to the surface of the sheet-guiding cylinder 8 in the varnishing station. Analogous to the counter-pressure cylinder 2 of the last printing station, one or more drying apparatuses may also be assigned to the counter-pressure cylinder 2 of the varnishing station downstream of the form cylinder 5. The drying apparatuses T assigned to the counter-pressure cylinders 2 and the sheet guiding cylinders 8 preferably each is supported such that the distance from the cylinder surface is adjustable.

One or more drying apparatuses T according to the invention which act upon the reverse side of the sheet may be assigned to the sheet guide 12 in the take-off drum 9 analogous to the drying apparatuses T arranged in the sheet guides 11. One or more drying apparatuses T also be arranged in the entrance of the delivery system 10, wherein these drying apparatuses act upon the printed side of the sheet and are supported for controlled positioning so as to allow gripper systems that hold the sheets to pass. In a sheet-fed offset printing machine for obverse and reverse printing, the transfer drums 1 may also consist of turning drums.

What is claimed is:

1. A sheet-fed printing machine comprising:

a sheet transfer system for directing printed sheets in a sheet path through the printing machine, a drying apparatus for drying sheets moving along the sheet path, said drying apparatus including an electrode that is connectable to a high voltage source, and a control for controlling the application of voltage to said electrode from said high voltage source in relation to and dependent upon specific operation of the printing machine.

2. The drying apparatus of claim 1 in which said control controls the application of voltage to said electrode from said high voltage source in relation to the length of sheets directed along said sheet path.

3. The drying apparatus of claim 1 in which said control controls the application of voltage to said electrode from said high voltage source in relation to the speed of operation of the printing machine.

4. The drying apparatus of claim 1 in which said drying apparatus includes a blasting nozzle for directing air onto said moving sheets.

5. The drying apparatus of claim 1 in which said drying apparatus includes a radiator for directing infrared radiation onto the moving sheets.

6. The drying apparatus of claim 1 in which said drying apparatus includes a suction device for drawing air from an area adjacent where sheets are acted upon by the dryer apparatus.

7. The drying apparatus of claim 1 including an angle transmitter operable for transmitting signals in relation to operation of said printing machine, and said control is operable for controlling the voltage to said electrode in response to signals from said, angle transmitter.

8. The drying apparatus of claim 1 in which said drying apparatus is located for heating a printed side of sheets moving along said sheet path.

9. The drying apparatus of claim 1 in which said drying apparatus is located for heating a side of the sheets reverse from a printed side as they move along said sheet path.

10. The drying apparatus of claim 1 in which said electrode is mounted for selected movement away from the path of movement of said sheets.

11. The drying apparatus of claim 10 in which said electrode is mounted for movement in a path substantially perpendicular to the direction of movement of the sheets along said sheet path.

12. The drying apparatus of claim 11 including an angle transmitter or transmitting signals in relation to operation of said printing machine, and an actuatable support for moving said electrode under the control of said control and in response to signals from said angle transmitter.

13. The drying apparatus of claim 10 in which said sheet transfer system includes gripping devices for holding and moving said sheets along said sheet path, and said electrode is selectively movable relative to the sheet path to permit passage of the gripping devices without interference.

14. The drying apparatus of claim 1 in which said drying apparatus includes a blasting nozzle for directing air onto said moving sheets, and a radiator for directing infrared radiation onto the moving sheets.

15. The drying apparatus of claim 14 in which said drying apparatus includes a suction device for drawing air from an area adjacent where sheets are acted upon by the dryer apparatus.

16. The drying apparatus of claim 14 including an angle transmitter operable for transmitting signals in relation to operation of said printing machine, and said control is operable for controlling the voltage to said electrode in response to signals from said angle transmitter.

* * * * *